US011072198B1

(12) United States Patent
Savryha et al.

(10) Patent No.: US 11,072,198 B1
(45) Date of Patent: Jul. 27, 2021

(54) MODULAR PAPER ORGANIZER

(71) Applicants: Vitalii Savryha, Dnepr (UA); Volodimir I. Vavrenyuk, Kamlanske (UA)

(72) Inventors: Vitalii Savryha, Dnepr (UA); Volodimir I. Vavrenyuk, Kamlanske (UA)

( * ) Notice: Subject to any disclaimer, the term of this patent is extended or adjusted under 35 U.S.C. 154(b) by 0 days.

(21) Appl. No.: 17/151,892

(22) Filed: Jan. 19, 2021

(51) Int. Cl.
*B42F 7/10* (2006.01)
*A47F 5/00* (2006.01)

(52) U.S. Cl.
CPC ..... *B42F 7/10* (2013.01); *A47F 5/005* (2013.01)

(58) Field of Classification Search
CPC .. B42F 7/10; B42F 17/10; B42F 17/08; B42F 17/02; A47B 57/588; A47B 57/583; A47B 65/15; A47B 57/585; A47B 96/04; A47B 65/10; A47B 65/00; A47B 57/58; A47B 88/975; A47B 2088/977; A47F 5/132; A47F 5/0062; A47F 7/144; A47F 7/0014; A47F 7/147; A47F 5/005; A47F 7/145; A47F 2005/165; A47F 7/0028; A47F 7/0021
USPC ..... 211/10, 11, 49.1, 50, 52, 55, 184, 69.1, 211/71.01, 65, 60.1, 85.18; 206/425
See application file for complete search history.

(56) References Cited

U.S. PATENT DOCUMENTS 58,716 A * 10/1866 Crossman ..... B42F 17/02 211/50
72,009 A * 12/1867 Foster ..... A47G 21/14 248/37.3
807,084 A * 12/1905 Muller ..... B42F 17/08 211/11
D43,080 S * 10/1912 Ajuria ..... D6/573
1,332,087 A * 2/1920 Vogel ..... B42F 17/08 312/351
1,383,570 A * 7/1921 Schnell ..... B42F 7/10 206/449
1,415,110 A * 5/1922 Pearl ..... B42F 17/02 211/11
1,419,485 A * 6/1922 Arcaro ..... A47B 65/15 211/11
1,609,945 A * 12/1926 Hermani ..... A47F 3/14 211/135
1,682,667 A * 8/1928 Eifel ..... B42F 7/145 211/11

(Continued)

*Primary Examiner* — Jonathan Liu
*Assistant Examiner* — Devin K Barnett
(74) *Attorney, Agent, or Firm* — Lawrence G. Fridman, Esq.; Feigin & Fridman, LLC

(57) ABSTRACT

A modular paper organizer, including a base and a plurality of dividers. The base includes a plurality of receiving units, each including a U-shaped surface defining a receiving slot, a first surface disposed at a first angle to one side of the U-shaped surface, and a second surface disposed at a second angle to an opposing side of the U-shaped surface. The second surface one receiving unit is attached to the first surface of an adjacent receiving unit. Each divider includes a planar body, and first and second engagement legs along the same edge of the planar body. The second engagement is at an acute angle to the first engagement leg and at an obtuse angle to the planar body. Each divider has one leg in a receiving slot, and the other leg resting against one of the first and second surfaces adjacent the receiving slot.

12 Claims, 5 Drawing Sheets

(56) References Cited

U.S. PATENT DOCUMENTS 1,712,054 A * 5/1929 Sheard ..... A47B 57/58 108/61
1,857,305 A * 5/1932 Holliday ..... G07D 11/12 206/561
1,966,555 A * 7/1934 Le Febure ..... B42F 17/18 211/11
2,099,906 A * 11/1937 Pierce ..... A47K 1/09 211/65
2,103,241 A * 12/1937 Bell ..... B65D 5/505 206/391
2,162,576 A * 6/1939 Galton ..... A47F 5/005 211/126.1
2,190,567 A * 2/1940 Jung ..... A47F 7/283 248/108
2,300,781 A * 11/1942 Gilley ..... A47B 81/007 211/41.1
2,560,161 A * 7/1951 Fay ..... A47F 5/005 211/72
D165,194 S * 11/1951 Schiffer ..... D19/90
2,590,732 A * 3/1952 Simancik ..... B42F 7/10 224/191
D170,798 S * 11/1953 Dundon ..... D15/140
2,751,088 A * 6/1956 Hargett ..... A47F 3/12 211/55
2,873,860 A * 2/1959 Holloway ..... A47B 63/02 211/50
D187,237 S * 2/1960 Kindelberger ..... D7/549
3,591,032 A * 7/1971 Baxter ..... B65D 1/36 217/26.5
3,661,271 A * 5/1972 Fisher ..... A47F 5/0025 211/88.01
3,754,646 A * 8/1973 Henig ..... B65D 1/36 211/50
4,004,501 A * 1/1977 Guerrero ..... A21C 15/02 99/426
D246,491 S * 11/1977 D'Alo ..... D6/682.4
4,163,497 A * 8/1979 McEwen ..... B42F 17/12 211/11
4,164,309 A * 8/1979 Staats ..... B42F 17/08 190/115
4,312,548 A * 1/1982 Posso ..... A47B 88/969 312/9.52
D267,143 S * 12/1982 Gessing ..... D7/411
4,406,368 A * 9/1983 Hermes ..... B43M 99/008 206/1.7
4,577,773 A * 3/1986 Bitel ..... A47B 88/994 220/533
4,603,825 A * 8/1986 Kotliar ..... A47G 19/30 206/525
4,611,720 A * 9/1986 Staab ..... A47F 7/0021 211/184
4,629,067 A * 12/1986 Pavlik ..... G11B 33/0433 206/308.3
D291,269 S * 8/1987 Richards ..... D7/504
4,796,761 A * 1/1989 Hermelin ..... B42F 17/02 211/11
4,815,600 A * 3/1989 Niles ..... G11B 33/0438 206/308.3
4,819,813 A * 4/1989 Schubert ..... G11B 23/0236 211/26.1
4,832,208 A * 5/1989 Finnegan ..... A47F 5/005 206/564
4,875,650 A * 10/1989 Goodell ..... A47H 2/00 248/261
D309,518 S * 7/1990 Viklund ..... D3/313
4,944,412 A * 7/1990 Daigre ..... B42F 17/02 211/11
D316,347 S * 4/1991 Getto ..... D18/48
D319,372 S * 8/1991 Cobb ..... D7/504
D327,606 S * 7/1992 Oellig ..... D6/678.4
5,163,549 A * 11/1992 Hayduchok ..... A45C 11/34 206/214
D333,489 S * 2/1993 Stern ..... D19/86
D334,867 S * 4/1993 May ..... D7/504
D336,182 S * 6/1993 Machut ..... D6/310
D349,815 S * 8/1994 Wolff ..... D28/61
D352,454 S * 11/1994 Krupa ..... D9/425
5,368,161 A * 11/1994 Plais ..... A61C 19/02 206/369
5,411,145 A * 5/1995 Parks ..... A47B 63/00 211/50
5,447,243 A * 9/1995 Graber ..... B43M 99/008 206/371
5,456,379 A * 10/1995 Krupa ..... B65D 81/263 220/835
5,485,928 A * 1/1996 Felton ..... A47F 7/145 211/128.1
D368,187 S * 3/1996 Johnson ..... D6/682
D374,582 S * 10/1996 Chu ..... D6/407
5,597,216 A * 1/1997 Real ..... G11B 23/0236 312/9.54
5,797,495 A * 8/1998 Lerrick ..... A47G 23/0625 206/503
5,799,910 A * 9/1998 Dexter ..... B65D 35/56 211/65
5,810,182 A * 9/1998 Levin ..... A47F 5/112 211/195
D404,220 S * 1/1999 Stravitz ..... D6/407
5,938,040 A * 8/1999 Goodwin ..... B43M 99/006 206/756
6,056,159 A * 5/2000 Layer ..... B65D 35/56 222/105
6,082,553 A * 7/2000 Stravitz ..... A47B 63/00 206/308.1
6,129,219 A * 10/2000 Peickert ..... A47B 88/90 211/74
6,161,704 A * 12/2000 Stravitz ..... A47F 7/141 211/189
6,164,461 A * 12/2000 Ward ..... G11B 33/0461 211/40
6,227,384 B1 * 5/2001 Saylor ..... A47B 17/033 211/11
D443,509 S * 6/2001 Nantel ..... D9/423
D445,287 S * 7/2001 Kujala ..... D6/629
6,332,546 B1 * 12/2001 Hunt ..... B42F 17/08 211/10
D461,100 S * 8/2002 Poarch ..... D7/553.1
6,439,399 B1 * 8/2002 Wegstein ..... A47F 7/145 211/128.1
6,497,461 B1 * 12/2002 Harlan ..... A47F 3/005 312/114
D470,360 S * 2/2003 Stanco ..... 211/85.4
6,607,084 B1 * 8/2003 Spinelli ..... A47F 7/0021 211/71.01
D487,971 S * 4/2004 Bergeron ..... D3/313
D499,607 S * 12/2004 Lyon ..... D7/504
D504,587 S * 5/2005 Root ..... D6/534
D510,600 S * 10/2005 Benn ..... D19/78
D516,914 S * 3/2006 Ducharme ..... D9/456
7,389,884 B2 * 6/2008 Stravitz ..... B42F 17/20 211/11
D615,396 S * 5/2010 Changpan ..... D9/425
7,975,857 B2 * 7/2011 Restis ..... A47L 19/02 211/70.7
D694,050 S * 11/2013 Eckert ..... D6/706
D694,051 S * 11/2013 Eckert ..... D6/706
D694,561 S * 12/2013 Eckert ..... D6/705
D695,546 S * 12/2013 Kruger ..... D6/534
D704,972 S * 5/2014 Eckert ..... D6/706
8,727,142 B2 * 5/2014 Shapiro ..... A47B 88/988 211/70.7
8,807,501 B2 * 8/2014 Chung ..... B25H 3/04 248/231.91
9,140,482 B2 * 9/2015 Popovitch ..... F25D 25/028
D812,476 S * 3/2018 Bergeron ..... D9/456
9,925,658 B2 * 3/2018 Schein ..... B25H 3/06
10,398,243 B2 * 9/2019 Sedgwick ..... A47G 19/30
D864,668 S * 10/2019 Bergeron ..... D7/553.2
10,470,573 B1 * 11/2019 Smith ..... A47B 88/975

(56) References Cited

U.S. PATENT DOCUMENTS

| | | | | |
|---|---|---|---|---|
| 2005/0023234 | A1* | 2/2005 | Head | A47G 19/30 211/85.4 |
| 2005/0218092 | A1* | 10/2005 | Rosen | B65D 5/4208 211/52 |
| 2005/0230330 | A1* | 10/2005 | Killinger | B42F 17/06 211/11 |
| 2010/0018886 | A1* | 1/2010 | Wilson | E21B 25/005 206/443 |
| 2013/0193148 | A1* | 8/2013 | Fula | B65D 25/04 220/520 |
| 2013/0213911 | A1* | 8/2013 | Theisen | G09F 3/204 211/59.4 |
| 2017/0267388 | A1* | 9/2017 | Whitford | B65C 9/40 |
| 2017/0295974 | A1* | 10/2017 | Lai | A47G 23/06 |
| 2018/0184816 | A1* | 7/2018 | Bellar | A47F 5/005 |
| 2018/0288961 | A1* | 10/2018 | Foght | B65D 85/76 |
| 2019/0159609 | A1* | 5/2019 | Kalm | A47F 5/0062 |

* cited by examiner

MODULAR PAPER ORGANIZER

FIELD AND BACKGROUND OF THE DISCLOSED TECHNOLOGY

The disclosed technology relates generally to office organizers, and, more specifically, to a modular paper organizer suitable for use on desktops or on a vertical surface such as a partition or a wall.

The modern office environment has ever increasing demands with respect not only to the availability of effective workspace, particularly regarding a work surface, but also with respect to utilization of surfaces around the work surface. The space taken up by computing and communication equipment, as well as stationary and other office supplies, often results in cluttered desks and limited workspace for the user. One type of item that has a particularly large footprint on the work surface are papers, which are often stacked on the desk, taking up precious space. When the papers need to be divided into different stacks, or otherwise separated, the problem is further compounded.

Prior art includes various types of paper organizers, to help users clear desk space by organizing paper in a device with a more limited footprint. However, most existing paper organizers continue to take up valuable and significant workspace, or alternately are closable and thus become inconvenient for a user who needs regular access to their papers. Another drawback of existing organizers is that their structure is typically fixed, and cannot be modified or determined, in a modular manner, by the user.

U.S. Pat. No. 1,463,733 to Turner is directed toward a desk organizer to provide a convenient means for receiving, in classified order, various papers and letters such as ordinarily gather on the desk. The organizer thereof is particularly adapted to hold a plurality of papers without losing its shape and without assuming a bulky appearance. The organizer includes a base, to which is connected a block having a slanted surface. A plurality of leaves is secured to the block. However, the organizer of Turner still takes up significant desk space, as seen in FIG. 1 thereof.

U.S. Pat. No. 1,551,302 to Gable is directed toward a record holder including a plurality of enveloped mounted in the form of a book, where the envelopes can be moved into a jalousie position to display the entire set of records. When the book is closed, the envelopes are arranged in an even stacked relation. However, the organizer of Gable includes a fixed number of envelopes in a fixed order and in fixed positions, and, when open, continues to take up significant desk space, as seen in FIG. 1 thereof.

U.S. Pat. No. 2,873,860 to Holloway is directed toward a stationary rack, which may be placed in a desk drawer or mounted atop a table or desk and is adapted to receive a plurality of sheets of different types. Papers in any one of the compartments forming part of the device are positioned so that the uppermost of such group of papers may be quickly and easily grasped by the user. The device includes a supporting foot attached to an underside of a panel, which assumes a position in a plane disposed at an acute angle to a horizontal plane upon which the supporting footrests. A plurality of panels is fixedly attached to the first panel and are identical in size and shape thereto.

U.S. Pat. No. 6,227,384 to Saylor et al is directed toward a divider arrangement for organizing documents including a base part for supportive engagement with either an elongate mounting rail positioned above a work surface or with a generally horizontal support surface. A plurality of divider elements projects upwardly from the base part. Each divider element is defined by an upwardly opening channel member having spaced-apart front and rear walls joined together by a bottom wall extending transversely therebetween, with a plurality of the channel members being supported on the base part in a sideways adjacent relationship so as to define a plurality of adjacent storage slots. Each of the channel members assume a slightly angled relationship relative to the base part so that the bottom wall extends at a slight angle relative to the horizontal and the front and rear walls extend at a slight angle relative to the vertical.

U.S. Design Pat. No. D707,474 to Tsai is directed to an organizer rack for holding papers in a vertically stacked rack, with multiple compartments.

There is thus a need in the art for a paper organizer which is modular, adjustable, and can have a small footprint and/or be wall mounted to preserve desk space.

SUMMARY OF THE DISCLOSED TECHNOLOGY

The disclosed technology relates generally to office organizers, and, more specifically, to a modular paper organizer suitable for use on desktops or on a vertical surface such as a partition or a wall.

According to an embodiment of the disclosed technology, there is provided a modular paper organizer, including a base and a plurality of dividers. The base includes a plurality of receiving units, each receiving unit including a U-shaped surface defining a receiving slot, a first surface, disposed on a first side of the U-shaped surface at a first angle relative thereto, and a second surface, disposed on a second, opposing side of the U-shaped surface at a second angle relative thereto. For each pair of adjacent receiving units, the second surface of one of the pair of adjacent receiving units is attached to the first surface of the other of the pair of adjacent receiving units. Each of the plurality of dividers includes a planar body having a first end and a second end, a first engagement leg, disposed at the second end of the planar body, and a second engagement leg, disposed at the second end of the planar body, the second engagement leg being at an acute angle to the first engagement leg and at an obtuse angle to the planar body. For each of the plurality of dividers, one of the first and second engagement legs is removably disposed in the receiving slot of a corresponding one of the pluralities of receiving units, and the other of the first and second engagement legs rests against one of the first and second surfaces of the corresponding one of the pluralities of receiving units.

In some embodiments, in a first orientation of the plurality of dividers within the receiving slots, the paper organizer is adapted for storing and organizing paper when the base is disposed on a substantially horizontal surface, and in a second orientation of the plurality of dividers within the receiving slots, the paper organizer is adapted for storing and organizing paper when the base is disposed on a substantially vertical surface.

In some embodiments, in the first orientation, for each of the plurality of dividers, the first engagement leg is removably disposed within the receiving slot, and the second engagement leg rests against the second surface, of the corresponding one of the pluralities of receiving units.

In some other embodiments, in the second orientation, for each of the plurality of dividers, the second engagement leg is removably disposed within the receiving slot, and first second engagement leg rests against the second surface, of the corresponding one of the pluralities of receiving units.

In yet other embodiments, in a third orientation, for each of the plurality of dividers, the first engagement leg is removably disposed within the receiving slot, and the second engagement leg rests against the first surface, of the corresponding one of the pluralities of receiving units. In some such embodiments, in the third orientation of the plurality of dividers, the modular paper organizer is adapted to store and organize papers when the base is disposed on a horizontal surface or on a vertical surface.

In some embodiments, for each of the plurality of dividers, the first engagement leg is disposed at an obtuse angle to the main body.

In some embodiments, for each pair of adjacent receiving units, the second surface of one of the pair of adjacent receiving units is disposed at an obtuse angle to the first surface of the other of the pair of adjacent receiving units.

According to another embodiment of the disclosed technology, there is provided a kit for forming a modular paper organizer, the kit including a base and a plurality of dividers. The base includes a plurality of receiving units, each receiving unit including a U-shaped surface defining a receiving slot, a first surface, disposed on a first side of the U-shaped surface at a first angle relative thereto, and a second surface, disposed on a second, opposing side of the U-shaped surface at a second angle relative thereto. For each pair of adjacent receiving units, the second surface of one of the pair of adjacent receiving units is attached to the first surface of the other of the pair of adjacent receiving units. Each of the plurality of dividers includes a planar body having a first end and a second end, a first engagement leg, disposed at the second end of the planar body, and a second engagement leg, disposed at the second end of the planar body, the second engagement leg being at an acute angle to the first engagement leg and at an obtuse angle to the planar body. The receiving slot of each of the plurality of receiving units is adapted to receive one of the first and second engagement legs of a corresponding one of the plurality of dividers, while the other of the first and second engagement legs is rests against one of the first and second surfaces adjacent the receiving slot.

In some embodiments, the receiving slots are adapted to receive the dividers in a first orientation for storing and organizing paper when the base is disposed on a substantially horizontal surface, and are adapted to receive the dividers in a second orientation for storing and organizing paper when the base is disposed on a substantially vertical surface.

In some embodiments, for each of the plurality of dividers, the first engagement leg is disposed at an obtuse angle to the main body.

In some embodiments, for each pair of adjacent receiving units, the second surface of one of the pair of adjacent receiving units is disposed at an obtuse angle to the first surface of the other of the pair of adjacent receiving units.

According to yet another embodiment of the disclosed technology, there is provided a base for a paper organizer, the base including a plurality of receiving units. Each receiving unit includes a U-shaped surface defining a receiving slot, a first surface, disposed on a first side of the U-shaped surface at a first angle relative thereto, and a second surface, disposed on a second, opposing side of the U-shaped surface at a second angle relative thereto. For each pair of adjacent receiving units, the second surface of one of the pair of adjacent receiving units is attached to the first surface of the other of the pair of adjacent receiving units. Each of the receiving slots is adapted to receive an engagement leg of a divider.

In some embodiments, for each pair of adjacent receiving units, the second surface of one of the pair of adjacent receiving units is disposed at an obtuse angle to the first surface of the other of the pair of adjacent receiving units.

BRIEF DESCRIPTION OF THE DRAWINGS

FIGS. 1A, 1B, and 1C are, respectively, a front view planar illustration, a sectional illustration (wherein FIG. 1B is section view according to section line A-A of FIG. 1A), and a perspective view illustration of a base forming part of a paper organizer according to embodiments of the disclosed technology.

FIGS. 3A, 3B, 3C, and 3D are, respectively, a side view planar illustration, a perspective view illustration, a front view planar illustration, and a sectional illustration (wherein FIG. 3D is section view according to section line B-B of FIG. 3C) of a paper organizer according to embodiments of the disclosed technology, including the base of FIGS. 1A to 1C and multiple dividers of FIG. 2, in a first arrangement thereof.

DETAILED DESCRIPTION OF EMBODIMENTS OF THE DISCLOSED TECHNOLOGY

In an embodiment of the disclosed technology, a modular paper organizer includes a base having a plurality of receiving units, each receiving unit including a receiving slot, surrounded by two inclined surfaces. Each receiving slot is adapted to receive an engagement leg of a divider. Each divider includes a body as well as first and second engagement legs, the legs having a predetermined angle therebetween. The modular paper organizer may have different arrangements, for example different angular arrangements between the base and the main body of the dividers, depending on which of the first and second engagement legs is inserted into the receiving slot, and on the direction in which the divider is facing when one of the first and second engagement legs is disposed within the receiving slot.

Embodiments of the disclosed technology will become clearer in view of the following description of the drawings.

Figure 1A:
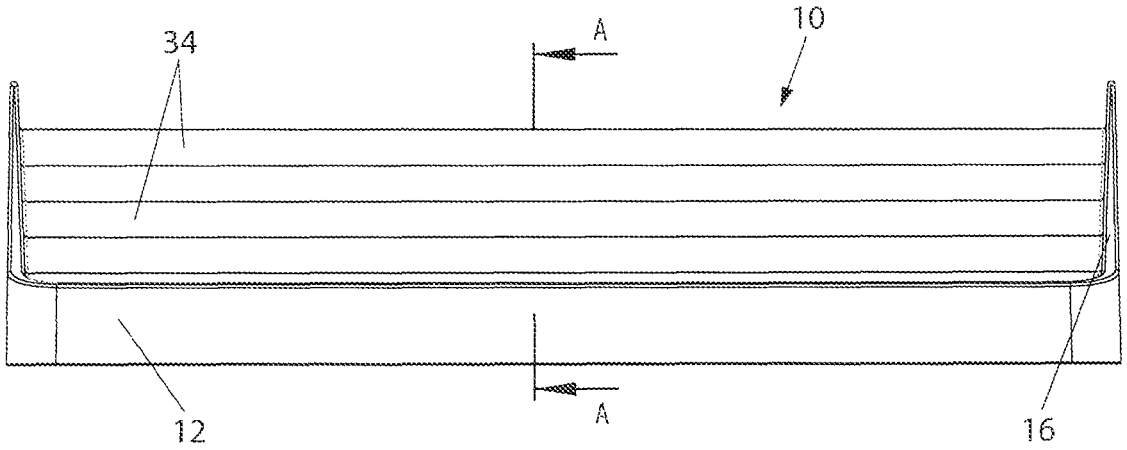
Figure 1B:
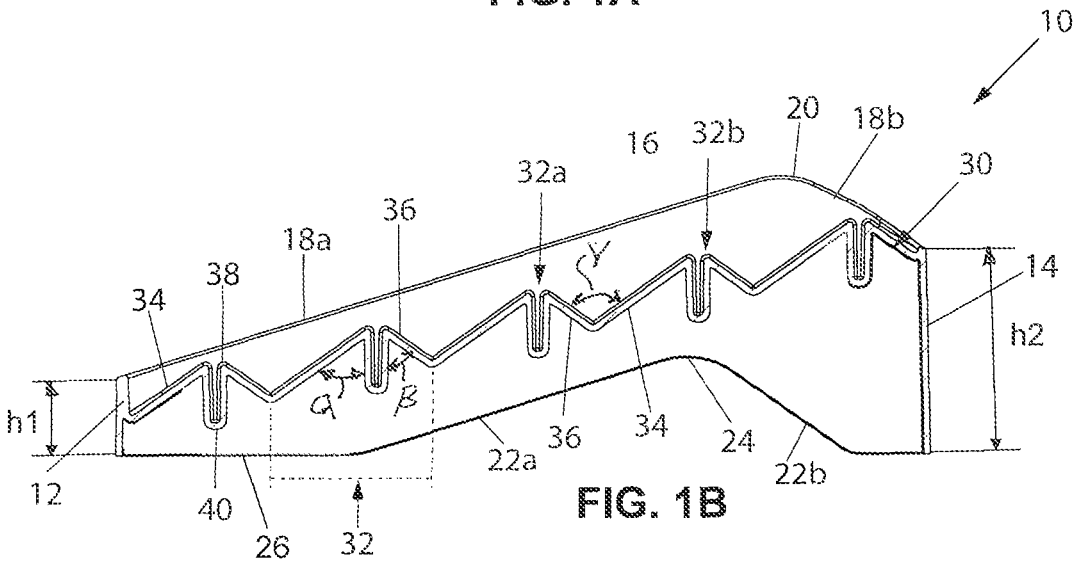
Figure 1C:
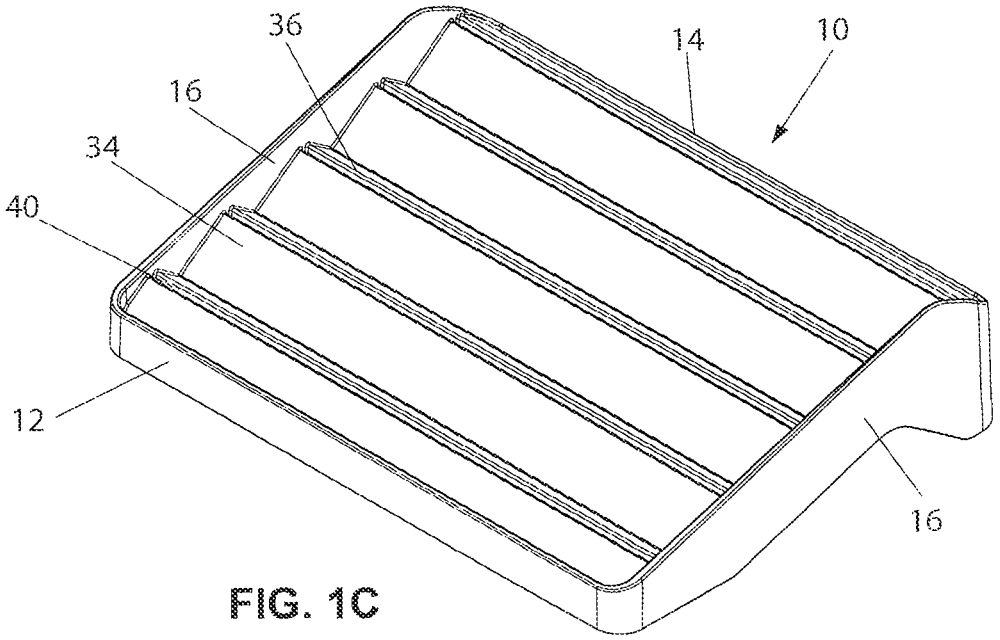

Reference is now made to FIGS. 1A, 1B, and 1C, which are, respectively, a front view planar illustration, a sectional illustration, and a perspective view illustration of a base 10 forming part of a paper organizer according to an embodiment of the disclosed technology.

Base 10 includes a front wall 12, a back wall 14, and side walls 16. Front wall 12 has a first height h1, while back wall 14 has a second height h2. In some embodiments, such as the illustrated embodiment, h2 is greater than h1. Side walls 16 are symmetrical to each other, and have an upper edge including a first portion 18*a* and a second portion 18*b* meeting at an upper apex 20. In some embodiments, such as the illustrated embodiment, the lower edge of side walls 16 includes a first portion 22*a* and a second portion 22*b*, meeting at a lower apex 24. First portion 22*a* and second portion 22*b* are flanked by substantially horizontal portions 26. Apices 20 and 24 are closer to back wall 14 than to front wall 12. In this embodiment, the angle formed by portions 22*a* and 22*b* has a similar contour to the angle formed by portions 18*a* and 18*b*. In some other embodiments, not illustrated, the lower edge of each side wall 16 is substantially horizontal throughout the distance between the front and back walls.

Extending between front wall 12 and back wall 14, at a height lower than the upper edge 18A, 18B of side walls 16, is a main surface 30, defining a plurality of receiving units 32. Each receiving unit 32 includes a first surface 34, a second surface 36, and a generally U-shaped space 38 disposed therebetween. The U-shaped space 38 includes a pair of substantially vertical portions and a connecting portion (which can be rounded in some embodiments), and defines a receiving slot 40, adapted to receive a divider of the paper organizer, as described in further detail hereinbelow. Each receiving slot 40 extends substantially the entire width of the base 10, from one side wall 16 to the other.

A first angle $\alpha$ is defined between each first surface 34 and an adjacent vertical portion of the adjacent U-shaped space 38. A second angle $\beta$ is defined between each second surface 36 and an adjacent vertical portion of the adjacent U-shaped surface space 38. A third angle $\gamma$ is defined between a second surface 36 of one receiving unit 32*a*, and a first surface 34 of a second, adjacent, receiving unit 32*b*.

In some embodiments, all first angles $\alpha$ of all the receiving units 32 are the same size. In some embodiments, all second-angles $\beta$ of all the receiving units 32 are the same size. In some embodiments, all third angles $\gamma$ between each pair of adjacent receiving units 32 are the same size. In some embodiments, angles $\alpha$ are equal to angles $\beta$. In other embodiments, angles $\alpha$ are greater than angles $\beta$. In some embodiments, first surfaces 34 are longer than second surfaces 36.

In some embodiments, such as the illustrated embodiment, the main surface 30 is sloped from a top end of back wall 14 to a middle portion of front wall 12. The slope of main surface 30 is beneficial to ensure that when dividers are inserted into the receiving slots, the heights of the dividers are staggered, and the tops of the dividers are easily visible from the front of the organizer, as explained in further detail hereinbelow. In such embodiments, side walls 16 are configured that the side wall is higher than the entirety of main surface 30, such that all receiving slots 40 have side walls 16 extending above a top end thereof.

Figure 2:
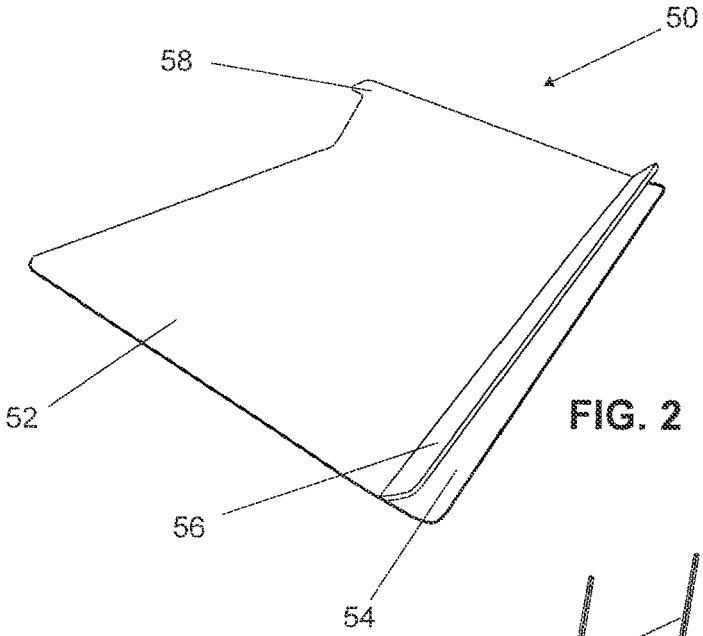
FIG. 2 is perspective view illustration of a divider forming part of a paper organizer according to an embodiment of the disclosed technology.

Reference is now made to FIG. 2, which is a perspective view illustration of a divider 50 forming part of a paper organizer according to embodiments of the disclosed technology. As seen, divider 50 has a substantially planar body 52, terminating, at a lower end thereof, in a first extension leg 54 and a second extension leg 56. Each extension leg extends along the entire width of the body 52. First extension leg 54 is angled with respect to second extension leg 56 by an acute angle x (see FIG. 3D), for example 55-60 degrees. Second extension leg 56 is angled with respect to body 52 by an obtuse angle Z, for example 110-120 degrees. In some embodiments, first extension leg 54 is in a single plane with body 52. In the illustrated embodiment, first extension leg 54 is angled relative to body 52 by an obtuse angle in the range of 165-175 degrees. In some embodiments (see FIGS. 2,3), an upper edge of body 52 is not linear, such that body 52 is not rectangular. In some such embodiments, body 52 includes a labeling tab 58 extending from an upper end thereof.

Reference is now made to FIGS. 3A, 3B, 3C, and 3D, which are, respectively, a side view planar illustration, a perspective view illustration, a front view planar illustration, and a sectional illustration of a paper organizer 100*a* according to an embodiment of the disclosed technology, including base 10 of FIGS. 1A to 1C and multiple dividers 50 of FIG. 2, in a first arrangement thereof.

As seen, in the arrangement of FIGS. 3A to 3D, the dividers 50 are inserted into the receiving units 32 such that first leg 54 is disposed within receiving slot 40, and second leg 56 leans against second surface 36. The dividers 50, and particularly bodies 52 thereof, appear graded from in the front planar view of FIG. 3C, because of the slope of main surface 30. Additionally, because of the angular orientation between first leg 54 and body 52 of the dividers, which, in the illustrated embodiment is an angle of approximately 170 degrees, the divider bodies are slightly slanted relative to the horizontal, as clearly seen in FIGS. 3B and 3D.

In the arrangement of FIGS. 3A to 3D, papers inserted into the organizer, between dividers 50, may lean against first surfaces 34 and may be supported by the divider behind the papers. The arrangement of organizer 100*a* as shown in FIGS. 3A to 3D is suitable for use on a tabletop, and the angular arrangement of the dividers ensures that the base can have a relatively small footprint, and still store various papers.

Figure 3A:
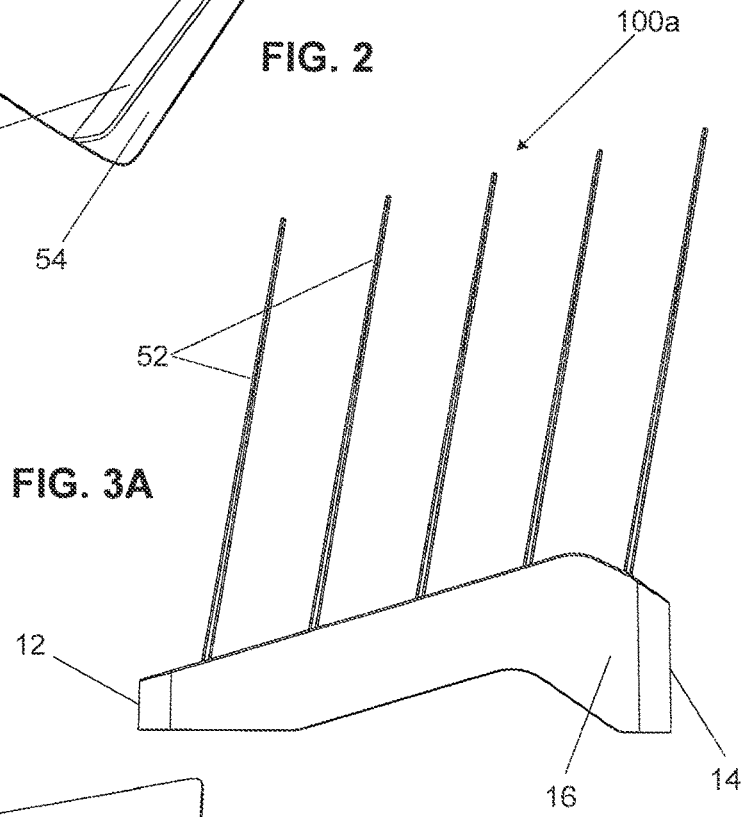
Figure 3B:
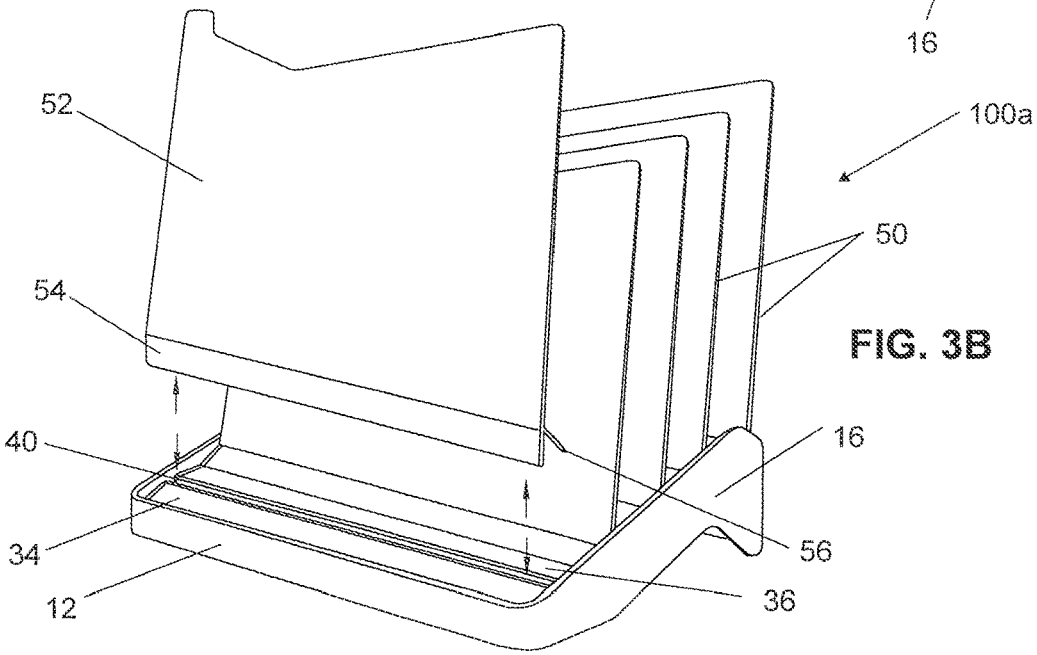
Figure 3C:
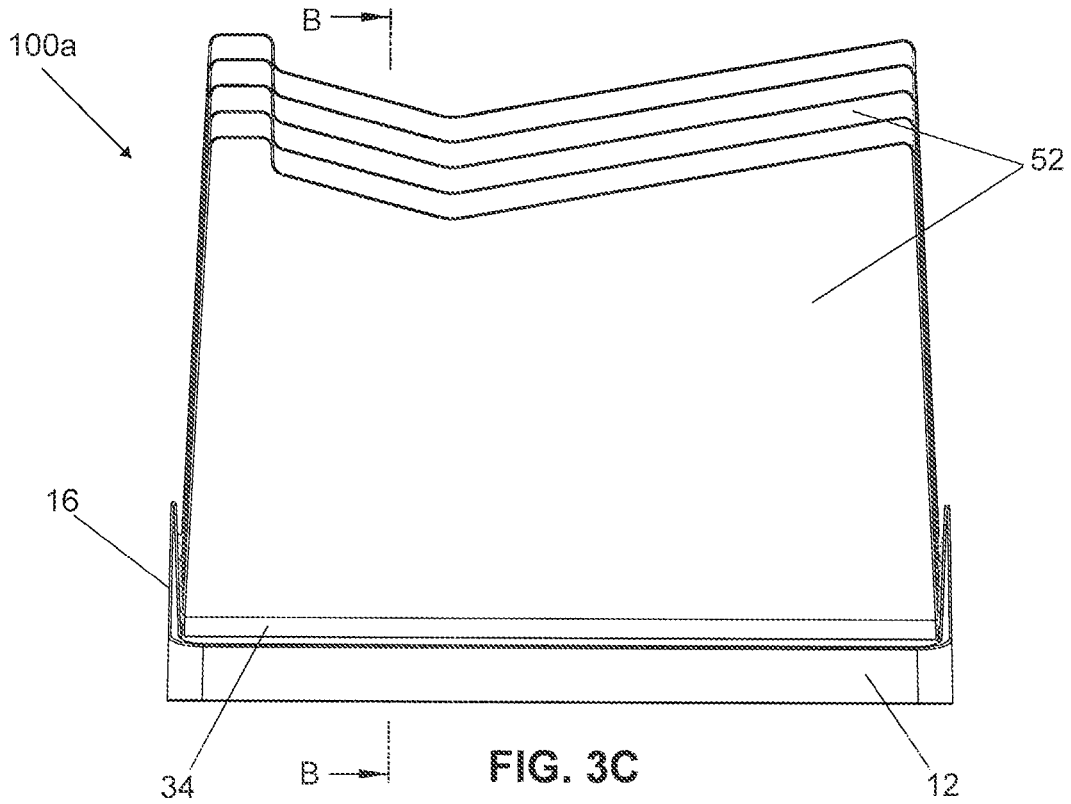
Figure 3D:
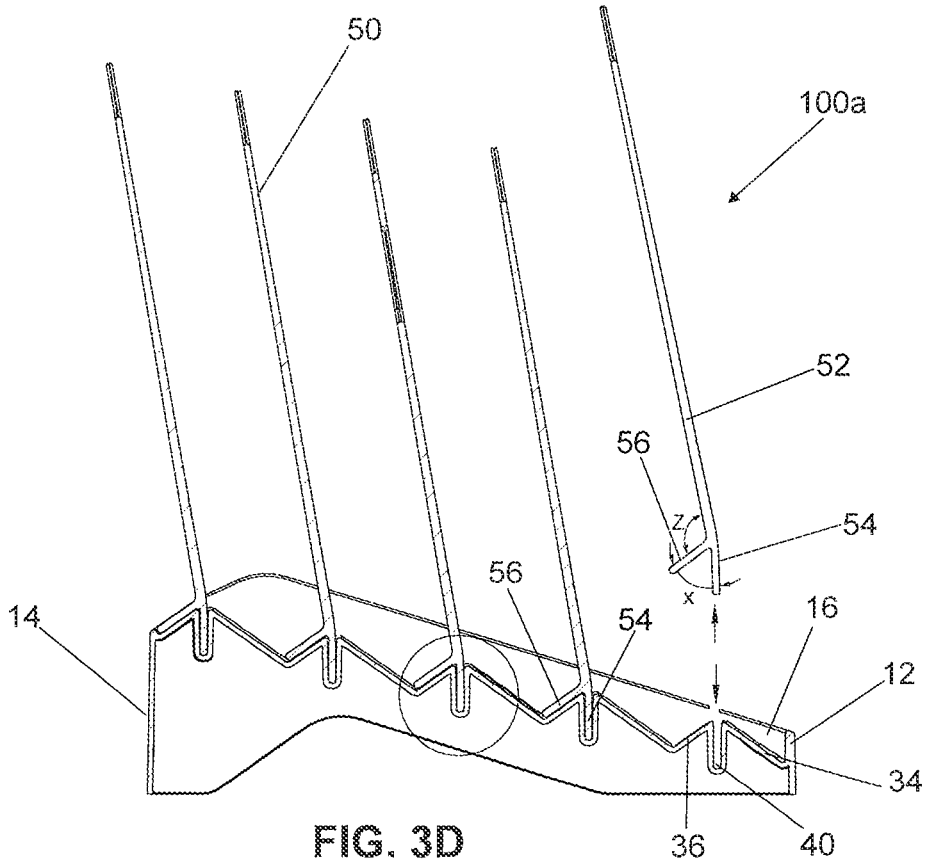

Additionally, in the arrangement of FIGS. 3A and 3B, the base 10 may be mounted vertically on a partition, with the back surface 14 pointed upward and the front wall 12 pointing downward. This orientation is more appropriate for the partition having slight backward inclination relative to the vertical and not where the surfaces 12 and 14 are parallel to horizontal. When mounted in this manner, because of the slight degree angle relative to the horizontal the dividers 50 will face slightly upward to ensure that papers inserted between the dividers cannot easily slip out of the organizer.

Figure 4A:
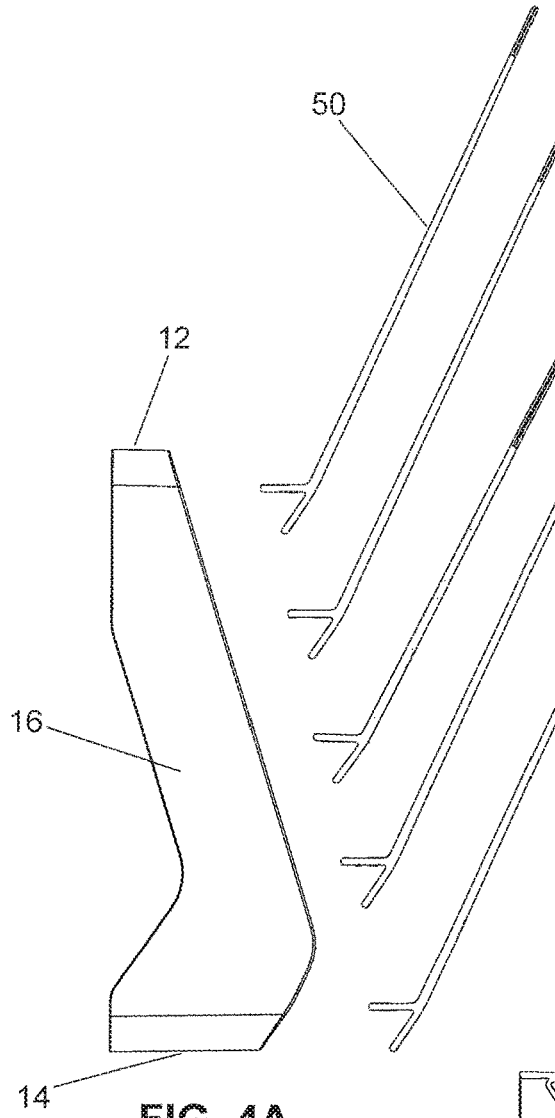
FIGS. 4A, 4B, and 4C are, respectively, a side view planar illustration, a sectional illustration, and an enlarged view sectional illustration of a paper organizer according to embodiments of the disclosed technology, including the base of FIGS. 1A to 1C and multiple dividers of FIG. 2, in a second arrangement thereof.
Figure 4C:
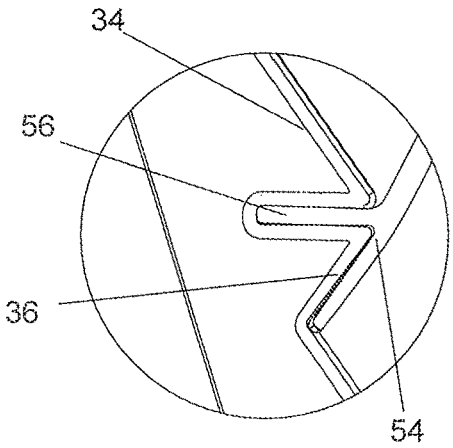
Figure 4B:
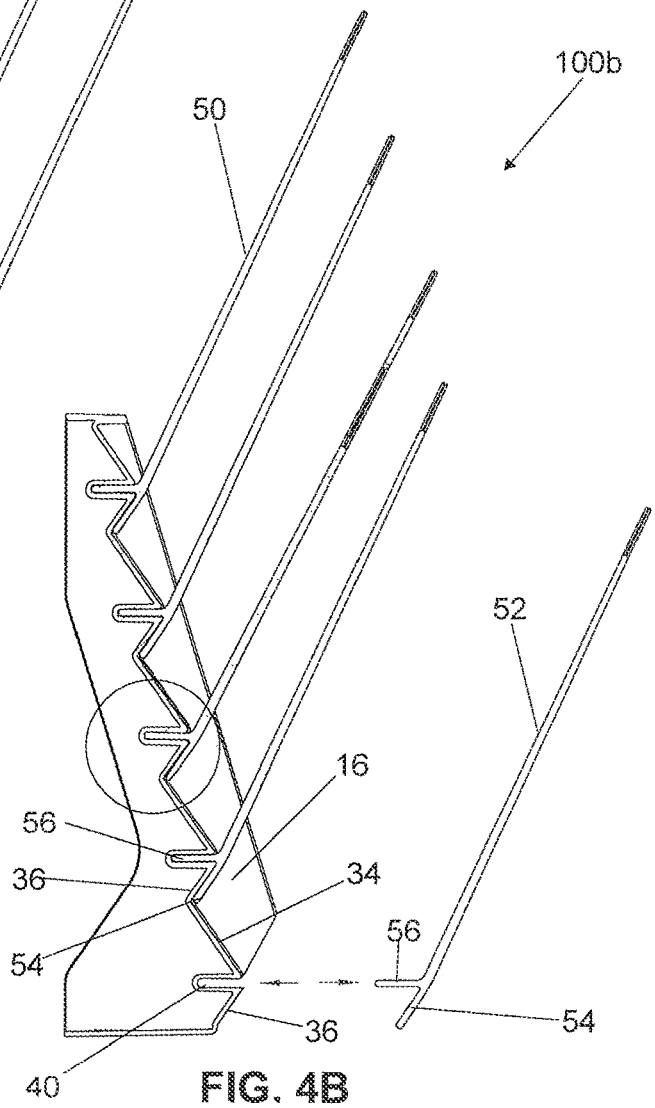

An arrangement which is adapted for vertically mounting the paper organizer of the disclosed technology is shown in FIGS. 4A, 4B, and 4C, which are, respectively, a side view planar illustration, a sectional illustration, and an enlarged view sectional illustration of a paper organizer 100*b* according to an embodiment of the disclosed technology. Paper organizer 100*b* includes base 10 of FIGS. 1A to 1C and multiple dividers 50 of FIG. 2, arranged in a second arrangement, different from that shown in FIGS. 3A to 3D.

As seen, in the arrangement of FIGS. 4A to 4C, the dividers 50 are inserted into the receiving units 32 such that second leg 56 is disposed within receiving slot 40, and first leg 54 leans against second surface 36. Because of the angular orientation between second leg 56 and body 52 of the dividers, which, in the illustrated embodiment is an angle Z of about 115 degrees, the dividers bodies are substantially slanted upwardly relative to the horizontal, as clearly seen in FIGS. 4A and 4B.

In the arrangement when organizer 100*b* is mounted on a vertical surface, such as a wall or partition divider, with the front wall 12 facing upwards and the back wall 14 facing downward, papers inserted into the organizer, between dividers 50, lean against a subsequent divider, and are substantially angled upwardly relative to the floor, or the horizon. In this manner, the papers are secured and unlikely to fall out of organizer 100*b*. Additionally, the slope of main surface 30 allows the lower dividers to be visible beneath the upper dividers, even when organizer 100*b* is wall mounted.

Figure 5:
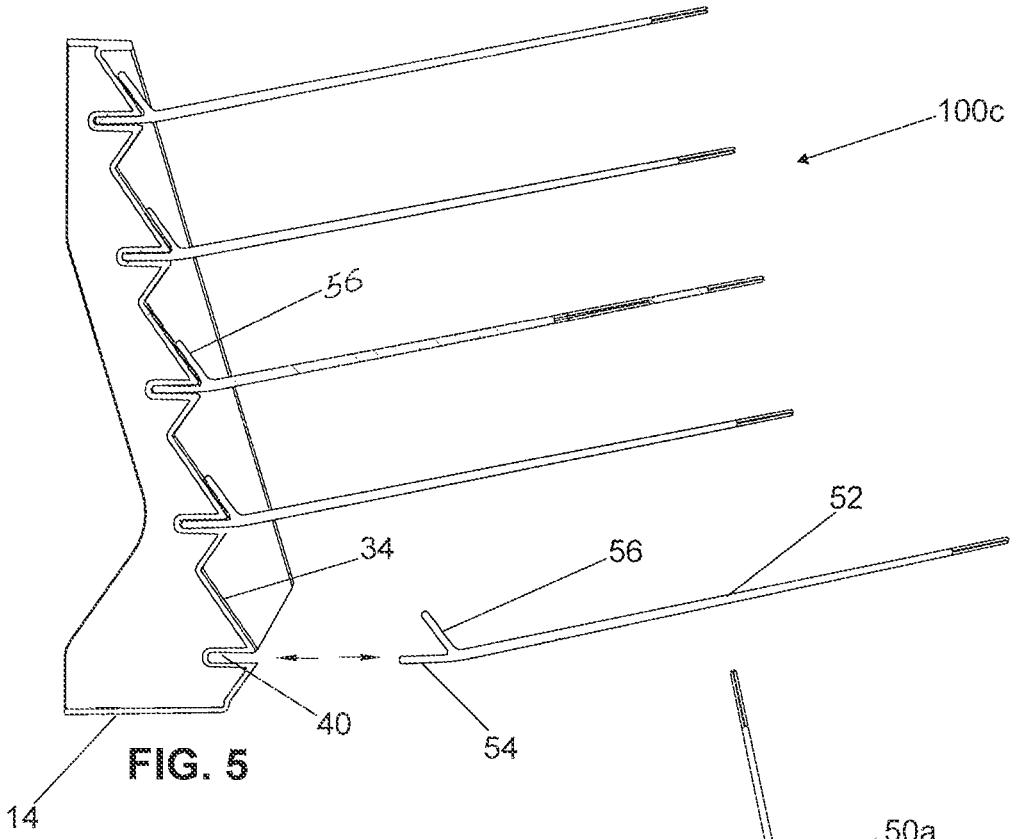
FIGS. 5 and 5A are illustrations of a paper organizer according to an embodiment of the disclosed technology, including the base of FIGS. 1A to 1C and multiple dividers of FIG. 2, in a third arrangement thereof.
Figure 5A:
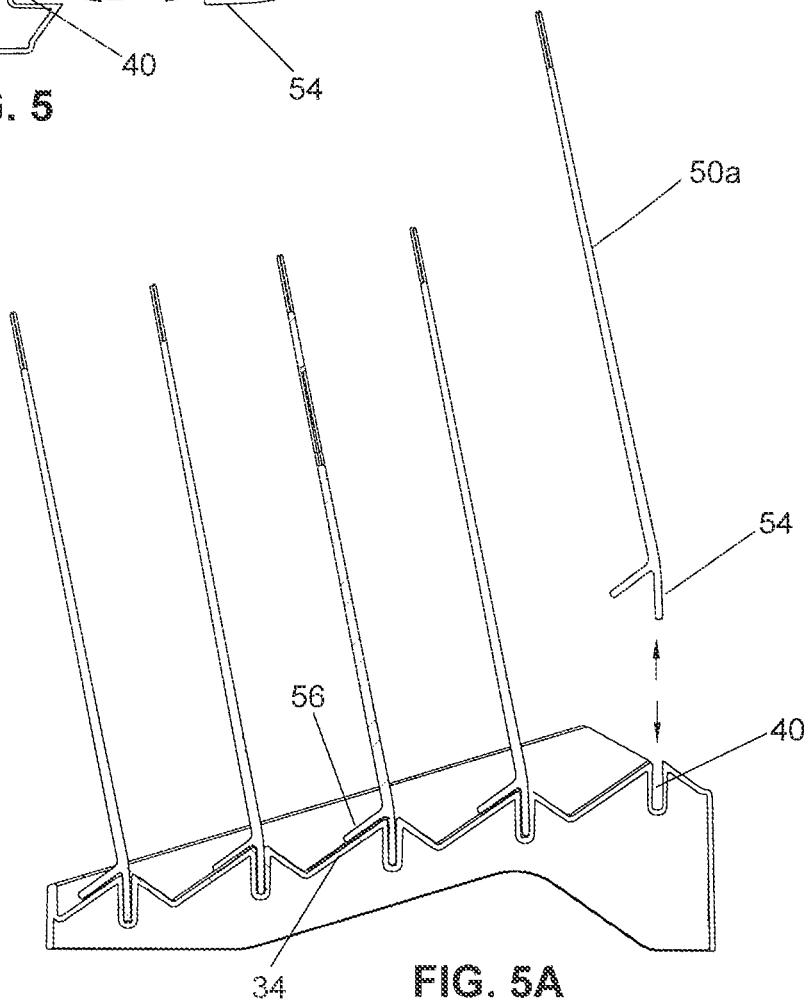

Reference is now made to FIG. 5, which is an illustration of a paper organizer 100*c* according to an embodiment of the disclosed technology, including base 10 of FIGS. 1A to 1C and multiple dividers 50 of FIG. 2, in a third arrangement thereof.

As seen, in the arrangement of FIG. 5, the dividers 50*a* are inserted into the receiving units 32 such that in each instance the first leg 54 is disposed within receiving slot 40, and second leg 56 leans against first surface 34. As such, the dividers are "facing the opposite direction" than in the arrangement of FIGS. 3A to 3D.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A modular paper organizer, comprising:

a base including a plurality of receiving units, each receiving unit including:

a U-shaped surface defining a receiving slot;

a first surface, disposed on a first side of said U-shaped surface at a first angle relative thereto;

a second surface, disposed on a second opposing side of said U-shaped surface at a second angle relative thereto, wherein, for each pair of said adjacent receiving units from said plurality of receiving units, said second surface of one of said pair of adjacent receiving units is attached to said first surface of the other of said pair of adjacent receiving units; and a plurality of dividers, each of said plurality of dividers including:

a planar body having a first end and a second end;

a first engagement leg, disposed at said second end of said planar body; and a second engagement leg, disposed at said second end of said planar body, said second engagement leg being disposed at an acute angle to said first engagement leg and at an obtuse angle to said planar body, wherein for each of the plurality of dividers, one of said first and second engagement legs is removably disposed in said receiving slot of a corresponding one of said plurality of receiving units, and the other of said first and second engagement legs rests against one of said first and second surfaces of said corresponding one of said plurality of receiving units.

2. The modular paper organizer of claim 1, wherein in a first orientation of said plurality of dividers within said receiving slots, said paper organizer is adapted for storing and organizing paper when said base is disposed substantially horizontally on a substantially horizontal surface, and in a second orientation of said plurality of dividers within said receiving slots, said paper organizer is adapted for storing and organizing paper when said base is disposed substantially vertically.

3. The modular paper organizer of claim 2, wherein in said first orientation, for each of said plurality of dividers, said first engagement leg is removably disposed within said receiving slot of said corresponding one of said plurality of receiving units, and said second engagement leg rests against said second surface of said corresponding one of said plurality of receiving units.

4. The modular paper organizer of claim 2, wherein in said second orientation, for each of said plurality of dividers, said second engagement leg is removably disposed within said receiving slot of said corresponding one of said plurality of receiving units, and said first engagement leg rests against said second surface of said corresponding one of said plurality of receiving units.

5. The modular paper organizer of claim 2, wherein in a third orientation, for each of said plurality of dividers, said first engagement leg is removably disposed within said receiving slot of said corresponding one of said plurality of receiving units, and said second engagement leg rests against said first surface, of said corresponding one of said plurality of receiving units.

6. The modular paper organizer of claim 5, wherein, in said third orientation, said modular paper organizer is adapted to store and organize papers when said base is disposed horizontally on a horizontal surface or said base is oriented vertically.

7. The modular paper organizer of claim 1, wherein, for each of said plurality of dividers, said first engagement leg is disposed at an obtuse angle to said planar body.

8. The modular paper organizer of claim 1, wherein for each pair of adjacent receiving units, said second surface of one of said pair of adjacent receiving units is disposed at an obtuse angle to said first surface of the other of said pair of adjacent receiving units.

9. A kit for forming a modular paper organizer, comprising:

a base including a plurality of receiving units, each receiving unit including:

a U-shaped surface defining a receiving slot;

a first surface, disposed on a first side of said U-shaped surface at a first angle relative thereto;

a second surface, disposed on a second opposing side of said U-shaped surface at a second angle relative thereto, wherein, for each pair of adjacent receiving units from said plurality of receiving units, said second surface of one of said pair of adjacent receiving units is attached to said first surface of the other of said pair of adjacent receiving units; and a plurality of dividers, each of said plurality of dividers including:

a planar body having a first end and a second end;

a first engagement leg, disposed at said second end of said planar body; and a second engagement leg, disposed at said second end of said planar body, said second engagement leg being at an acute angle to said first engagement leg and at an obtuse angle to said planar body;

wherein said receiving slot of each of said plurality of receiving units is adapted to receive one of said first and second engagement legs of a corresponding one of said plurality of dividers, while the other of said first and second engagement legs of the corresponding one of said plurality of dividers rests against one of said first and second surfaces adjacent said receiving slot of each of said plurality of receiving units.

10. The kit of claim 9, wherein said receiving slots are adapted to receive said dividers in a first orientation for storing and organizing paper when said base is disposed substantially horizontally on a substantially horizontal surface and are adapted to receive said dividers in a second orientation for storing and organizing paper when said base is disposed substantially vertically.

11. The kit of claim 9, wherein, for each of said plurality of dividers, said first engagement leg is disposed at an obtuse angle to said planar body.

12. The kit of claim 9, wherein for each pair of adjacent receiving units, said second surface of one of said pair of adjacent receiving units is disposed at an obtuse angle to said first surface of the other of said pair of adjacent receiving units.

* * * * *